US008726875B2

(12) United States Patent
Culp et al.

(10) Patent No.: US 8,726,875 B2
(45) Date of Patent: May 20, 2014

(54) EXHAUST FLANGE WITH PRESSURE CLAMP MOUNTING RAIL

(75) Inventors: James M. Culp, Rochester Hills, MI (US); Terry L. Blanchard, Clarkston, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 137 days.

(21) Appl. No.: 13/401,040

(22) Filed: Feb. 21, 2012

(65) Prior Publication Data

US 2013/0213343 A1 Aug. 22, 2013

(51) Int. Cl.
*F02B 67/00* (2006.01)

(52) U.S. Cl.
USPC ..... 123/195 A

(58) Field of Classification Search
USPC ..... 123/195 A
See application file for complete search history.

(56) References Cited

U.S. PATENT DOCUMENTS 5,636,515 A * 6/1997 Matsumoto et al. ..... 60/323
7,185,490 B2 3/2007 Smatloch et al.
2002/0153667 A1 * 10/2002 Battistoni et al. ..... 277/602

* cited by examiner

*Primary Examiner* — Lindsay Low
*Assistant Examiner* — Charles Brauch
(74) *Attorney, Agent, or Firm* — Ralph E Smith

(57) ABSTRACT

A system for mounting a duct to a port mounting in an engine where the port mounting has an opening and a mounting surface that surrounds the opening. The system includes a flange with a tongue portion that mates with a shoulder of a mounting rail that does not extend over the mounting surface of the port mounting, which allows for easy installation in locations with limited space.

20 Claims, 5 Drawing Sheets

EXHAUST FLANGE WITH PRESSURE CLAMP MOUNTING RAIL

FIELD

The present disclosure relates to a system and method for mounting an apparatus to a port of an internal combustion engine.

BACKGROUND

Vehicle manufacturers are constantly changing the design of vehicles and looking to increase the size of the passenger compartment without significantly increasing the size of the vehicle. Vehicle manufactures are also increasing the number of features found in vehicles without increasing the size of the vehicle. As a result, space allocated for vehicle engines is ever decreasing. Decreasing engine space, decreases access to ducts and other parts and makes it difficult to secure them to the engine.

Additionally, most vehicles are built on a production assembly line. To avoid delays along the assembly line, ducts and other parts must be easily attachable to partially assembled vehicles. Thus, there is a need for a system that provides easy attachment of ducts and other parts to an engine where there is limited access.

SUMMARY

The present disclosure provides a system for mounting a duct to a mounting surface that includes a port structure in an engine. The port mounting includes an opening and a mounting surface that surrounds the opening. The system includes a flange having a flange opening, a first side adjacent the flange opening that accepts fasteners, and a second side opposite the first side with a tongue portion that extends away from the flange opening and mates with the mounting surface of the port mounting. The system may further include a mounting rail having a shoulder spaced away from the mounting surface of the port mounting and mates with the tongue portion of the flange. The mounting rail may be positioned to be parallel to the mounting surface of the port mounting.

In one embodiment, the shoulder is positioned and configured to apply a leveraged clamping force to the tongue portion of the flange. In another embodiment, the flange may be sealed to the port mounting by the shoulder and fasteners applied to the first side of the flange. Additionally, having the shoulder not extending over the mounting surface of the port mounting may allow the tongue portion of the flange to be introduced between the shoulder and the mounting surface of the port mounting at an angled orientation to the mounting surface of the port mounting. In one embodiment, the angle may be approximately 10 degrees.

In one embodiment, the mounting rail may be mounted to an internal combustion engine and may have a "U" shape formed by first and second arms and a connecting arm that extends between the first and second arms. The first and second arms of the "U" shaped mounting rail may be mounted to the mounting surface of the port mounting and the shoulder may be connected to the connecting arm. In another embodiment, the system may include a gasket between the flange and the mounting surface of the port mounting.

The present disclosure further provides a method of mounting a manifold to a port mounting of an engine, wherein the port mounting has an opening and a mounting surface that surrounds the opening. The method may include positioning a mounting rail adjacent the port mounting where the mounting rail has a shoulder spaced away from the mounting surface of the port mounting and that does not extend over the mounting surface of the port mounting. The shoulder may be positioned to be parallel to the mounting surface of the port mounting. The method may further include inserting, e.g. sliding, a tongue portion of a first side of a flange between the mounting surface of the port mounting and the shoulder of the mounting rail so that the tongue portion extends away from an opening in the flange and is opposite a second side of the flange that has fastener openings.

In one embodiment, during the step of inserting the tongue portion, the flange may be at an angle, for example 10 degrees, with respect to the mounting surface of the port mounting. In another embodiment, the method may further include pivoting the flange toward the mounting surface of the port mounting and securing the second side of the flange to the mounting surface of the port mounting using fasteners that extend through the fastener openings.

In one embodiment, the step of securing the second side of the flange to the mounting surface of the port mounting causes the mounting rail to be positioned and configured to apply a leveraged clamping force to the tongue portion of the flange and seal the flange to the mounting surface of the port mounting. In another embodiment, the method may also include positioning a gasket between the mounting surface of the port mounting and the flange.

In one embodiment, the step of positioning the mounting rail adjacent the port mounting may include mounting the mounting rail to an internal combustion engine. In another embodiment, the mounting rail may have a "U" shape and the step of mounting the mounting rail to the internal combustion engine may include mounting first and second arms of the "U" shaped mounting rail to the mounting surface of the port mounting. In another embodiment, the shoulder of the "U" shaped mounting rail may be connected to a connecting arm that extends between the first and second arms.

Further areas of applicability of the present disclosure will become apparent from the detailed description, drawings and claims provided hereinafter. It should be understood that the detailed description, including disclosed embodiments and drawings, are merely exemplary in nature, intended for purposes of illustration only, and are not intended to limit the scope of the invention, its application, or use. Thus, variations that do not depart from the gist of the invention are intended to be within the scope of the invention.

DETAILED DESCRIPTION

Figure 1:
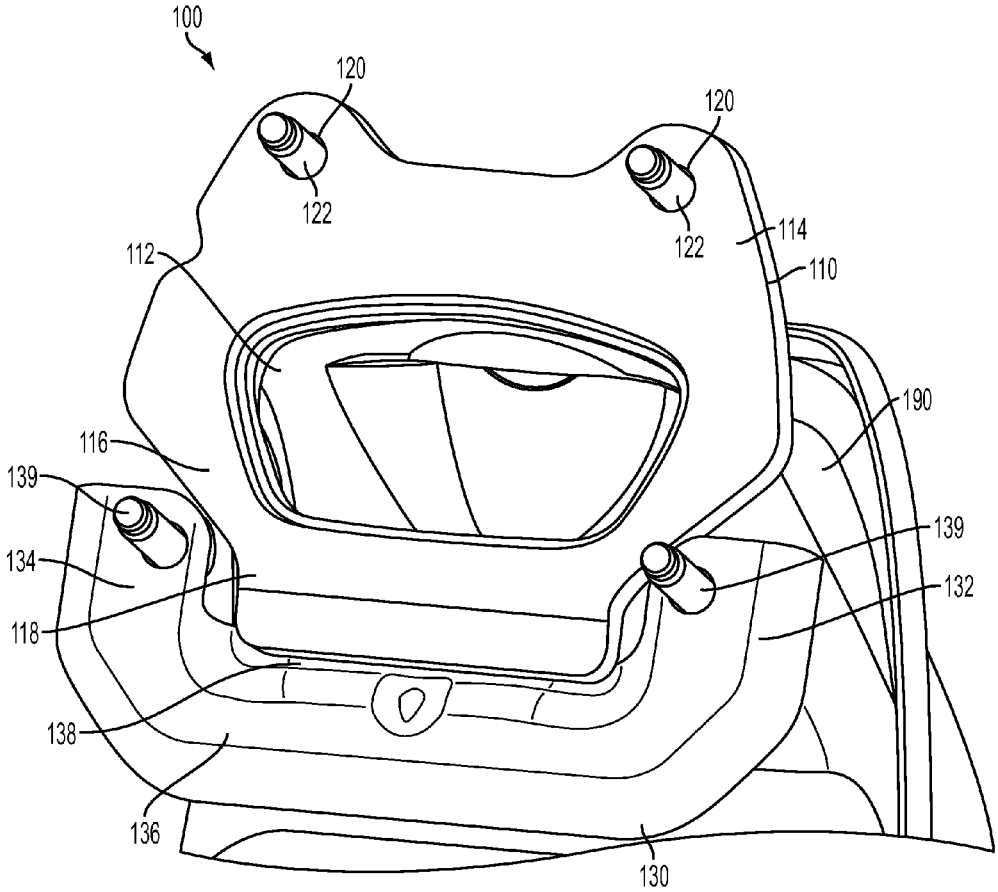
FIG. 1 illustrates a mounting system in accordance with an exemplary embodiment.

FIG. 1 illustrates a system 100 that is used to mount an engine exhaust gas duct 190 to an internal combustion engine in a vehicle according to an exemplary embodiment. The system 100 includes a mounting rail 130 and a flange 110 that mates with the mounting rail 130. The flange 110 includes a flange opening 112, top portion 114, bottom portion 116, tongue 118, flange fastener openings 120, and flange fasteners 122. The flange opening 112 is between the top portion 114 and bottom portion 116 of the flange 110. The tongue 118 is attached to the bottom portion 116 of the flange 110 and extends away from flange opening 112. The flange fastener openings 120 are in the top portion 114 of the flange 110 above the flange opening 112 and extend completely through the flange 110. The flange fasteners 122 extend through the flange fastener openings 120 and are used to fasten the top portion 114 of the flange 110 to an internal combustion engine. The flange 110 is coupled to the duct 190, better illustrated with respect to FIG. 2.

The mounting rail 130 includes a first arm 132, second arm 134, connecting arm 136, and shoulder 138. The mounting rail 130 has a "U" shaped formed by the first arm 132, second arm 134, and connecting arm 136. The first and second arms 132 and 134 form the sides of the "U" and are connected together by the connecting arm 136 that forms the bottom of the "U." The shoulder 138 connects to the connecting arm 136 and mates with the tongue 118 of the flange 110. It should be understood that the system 100 is not limited to connecting ducting to an engine. Rather, the system 100 may be used to connect any type of manifold such as piping, ducting, tubing, or channeling, to any apparatus. For example, the system 100 may be used to connect a wiring channeling to a wiring panel in a building. In addition, the connected manifold need not be tubular, but may be of a variety of shapes and sizes.

Figure 2:
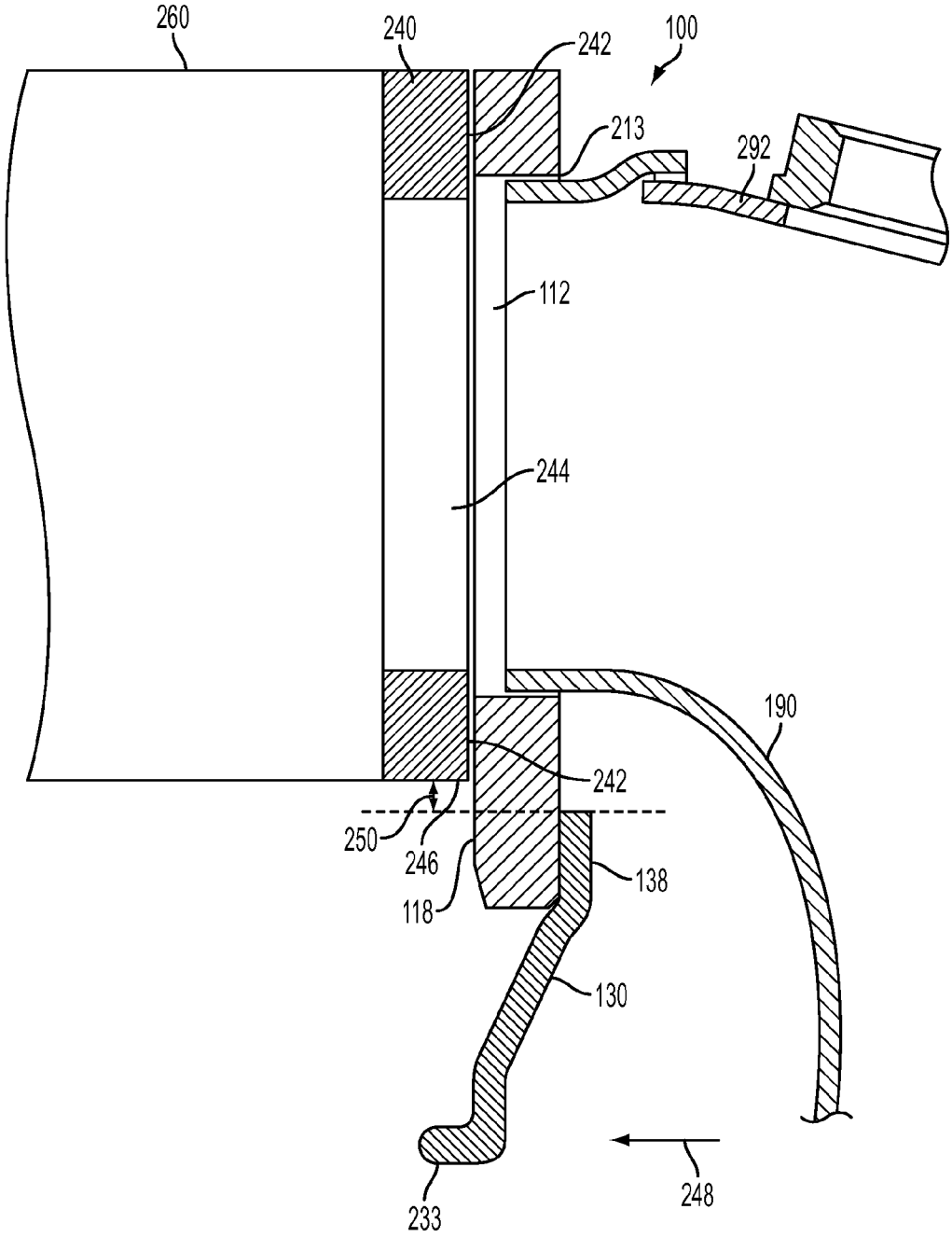
FIG. 2 illustrates a cross-sectional view of the mounting system of FIG. 1 accordance with an exemplary embodiment.

FIG. 2 illustrates a cross-sectional view of the system 100 mounted to a port mounting 240 of an internal combustion engine 260 according to an exemplary embodiment. The port mounting 240 includes an opening 244 that is surrounded by a port mounting surface 242. The shoulder 138 of the mounting rail 130 is spaced away from and parallel to the port mounting surface 242, but does not extend over the port mounting surface 242. The flange 110 is mounted to the port mounting 240 so that the flange opening 112 and the opening 244 are aligned and the flange 110 contacts the port mounting surface 242. The gap illustrated between the system 100 and the port mounting surface 242 in FIG. 2 is only to emphasize the separate components; once the system 100 and the port mounting surface 242 are secured together, the illustrated gap no longer exists. The flange fasteners 122 (shown in FIG. 1) secure the top portion 114 of the flange 110 to the port mounting 240.

The tongue 118 of the flange 110 contacts the port mounting surface 242 and extends to contact the shoulder 138 of the mounting rail 130 (any gap shown in FIG. 2 is for clarity purposes only). The mounting rail 130 exerts a leveraged clamping force to the tongue 118 of the flange 110 in the direction of arrow 248 to secure the bottom portion 116 (FIG. 1) of the flange 110 to the port mounting 240 when the flange fasteners 122 (FIG. 1) mount the top portion 114 (FIG. 1) of the flange 110 to the port mounting 240. The port surface 242 and the shoulder 138 are positioned and configured so that the distance between the port surface 242 and a mating surface of shoulder 138 is less than a thickness of tongue 118. This positioning and configuration of the port surface 242 and the mounting rail 130 (with shoulder 138) results in the mounting rail 130 and shoulder 138 exerting a leveraged force to the tongue 118, as will be explained in greater detail hereinafter. The mounting rail 130 may have a rolled edge 233 to increase the rigidity of the mounting rail 130 and thereby increase the leveraged clamping force exerted on the tongue 118.

As illustrated in FIG. 2, the mounting rail 130 is mounted so that an offset 250 is formed between a top of the shoulder 138 and an edge 246 of the port mounting 240 so that no portion of the shoulder 138 extends over the port mounting surface 242. The offset 250 allows the tongue 118 of the flange 110 to be inserted at an angle with respect to the port mounting surface 242 between the edge 246 and the shoulder 138 with minimal force applied by an assembly line worker. The height of the offset 250 may vary according to the size of the flange 110, the shoulder 138, and the port mounting 240. For example, in one embodiment where the tongue 118 is 22 mm, the offset 250 may have a height of about 0.3 mm. In another embodiment, the offset 250 may be larger or smaller. In another embodiment, the top of the shoulder 138 and the edge 246 may be aligned. It should be understood that the height of the offset 250 may be varied as long as the tongue 118 of the flange 110 is capable of being inserted at an angle with minimal force, the shoulder 138 does not extend over the port mounting surface 242, and the shoulder 138 exerts a force on the tongue 118 to secure the bottom portion 116 of the flange 110 to the port mounting 240 when the flange fasteners 122 are secured. In a further embodiment, the flange 110 may include a chamfer to aid in insertion of the flange 110, in an angled orientation, between the shoulder 138 and the port mounting surface 242.

Therefore, the positioning and configuration of both port mounting surface 242 and shoulder 138 is responsible for generating a leveraged force onto tongue 118. This leveraged force exerted by the shoulder 138, in combination with the flange fasteners 122 on the flange 110, results in a seal between the flange 110 and the port mounting surface 242. The shoulder 138 can be configured to have a thickness and/or rigidity that aids in creating a greater leveraged force, and thus a better seal between the mating portions of port mounting surface 242 and shoulder 138.

Figure 4:
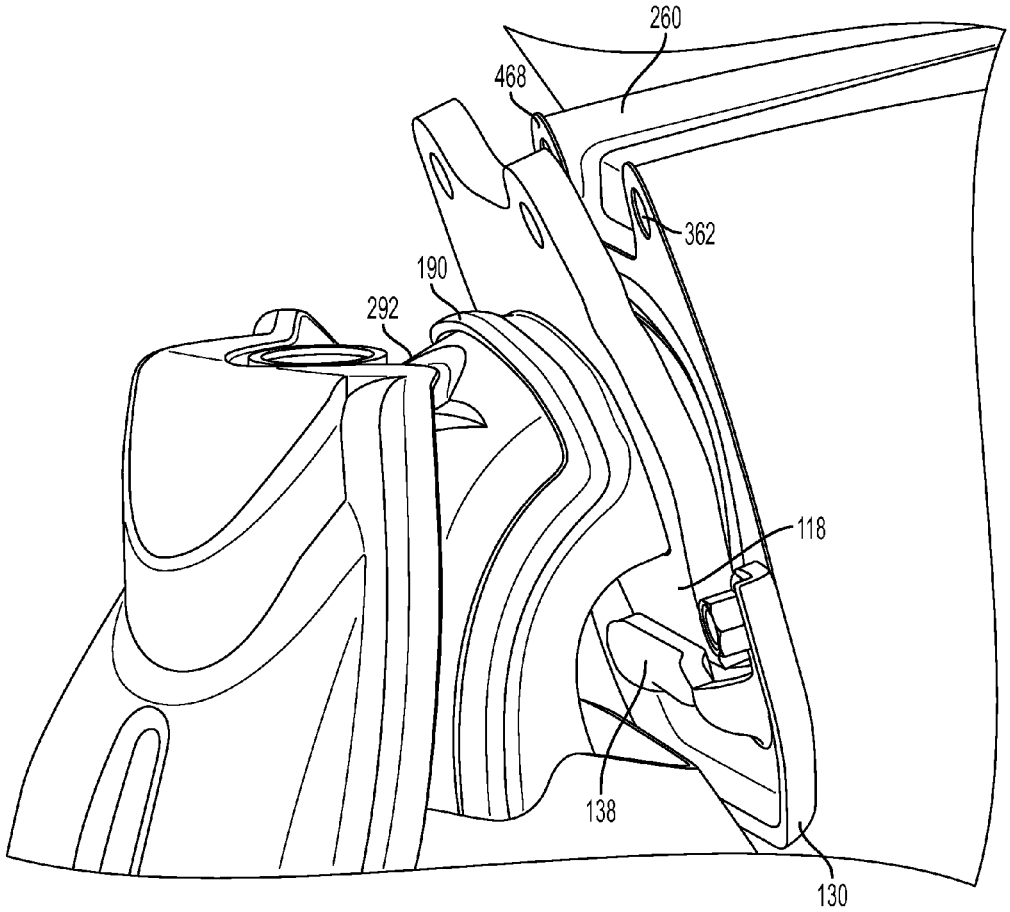
FIG. 4 illustrates a side view of the mounting system in accordance with an exemplary embodiment.
Figure 5:
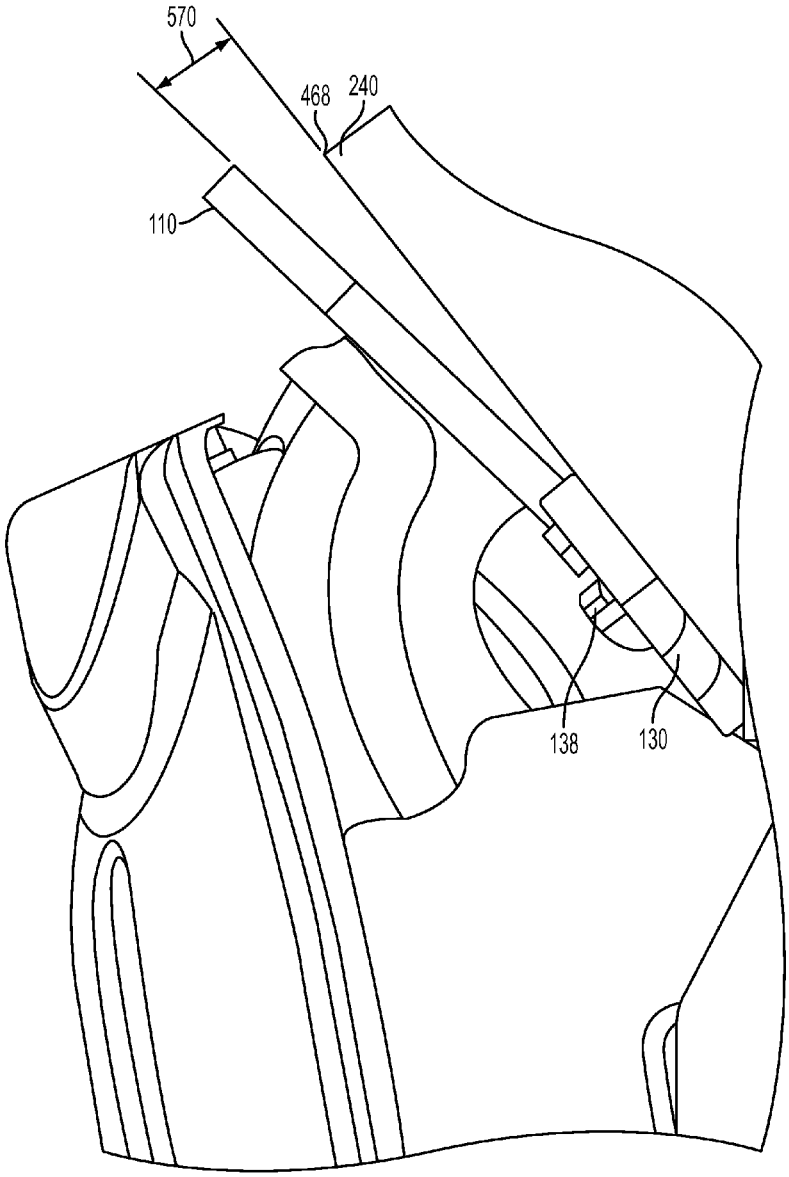
FIG. 5 illustrates another side view of the mounting system in accordance with an exemplary embodiment.

The seal is created to prevent exhaust gases from the internal combustion engine 260 from escaping as the gas travels out of the opening 244 and into the duct 190. In other embodiments, sealant, gaskets, or other material may be placed between the port mounting 240 and the flange 110. For example, FIGS. 4 and 5 illustrate a gasket 468 placed between the port mounting 240 and the flange 110 according to another exemplary embodiment.

FIG. 2 further illustrates the duct 190 as being attached to a rim 213 of the flange opening 112. The duct 190 may be attached to the rim 213 by welding the duct 190 to the rim 213. In another embodiment, the duct 190 may be attached to the rim 213 with fasteners, adhesive, or using some other method. FIG. 2 further illustrates a duct shell 292 that is attached to the duct 190 and completely encloses the duct 190 to prevent escape of exhaust gases.

Figure 3:
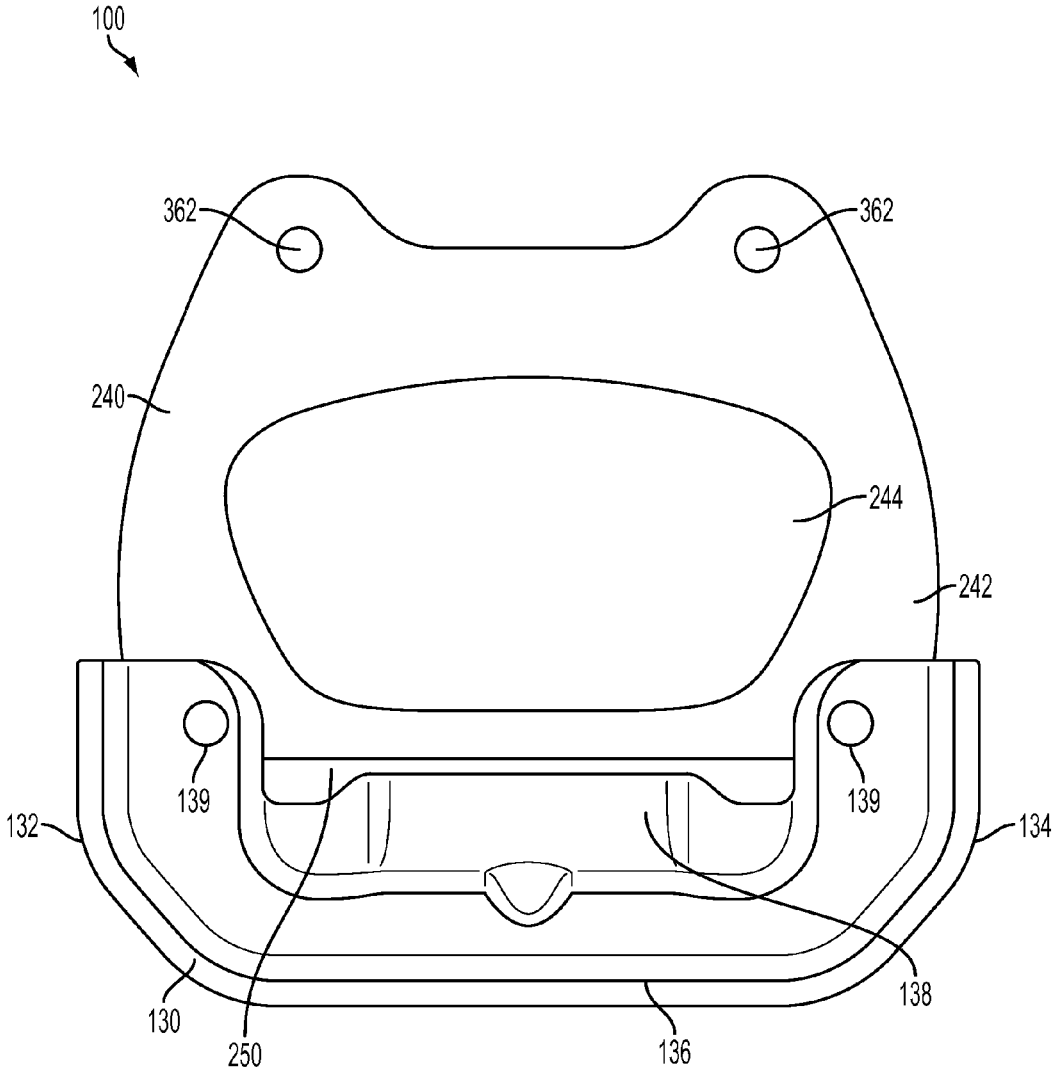
FIG. 3 illustrates a front view of a portion of the mounting system in accordance with an exemplary embodiment.

FIG. 3 illustrates a front view of an exemplary port mounting 240 of the internal combustion engine 260. The port mounting 240 includes port fastener openings 362 that align with flange fastener openings 120 to accept the engagement of flange fasteners 122 with the mounting surface. FIG. 3 further illustrates the mounting rail 130 attached to the port mounting 240. The first and second arms 132 and 134 of the mounting rail 130 are attached to the port mounting surface 242 with the engagement of fasteners 139. The connecting arm 136 and the shoulder 138 extend below the port mounting surface 242 to create the offset 250 between the shoulder 138 and the port mounting surface 242.

In another embodiment, the mounting rail 130 may be mounted to another location on the internal combustion engine 260 and not the port mounting surface 242. In this alternative embodiment, the mounting rail 130 may not have a "U" shape, but may be shaped to correctly position the shoulder 138 and to allow the shoulder 138 to apply a force to the flange 110 as previously described. It should be understood that the shape of the mounting rail 130 and where the mounting rail 130 is mounted may vary as long as the shoulder 138 does not extend over the port mounting surface 242, exerts a force on the tongue 118 to secure the bottom portion 116 of the flange 110 to the port mounting 240 when the flange fasteners 122 are secured, and allows the tongue 118 of the flange 110 to be inserted at an angle with minimal force. Furthermore, FIG. 3 illustrates the port mounting 240 as having only a single port opening 244. In another embodiment, the port mounting 240 may have multiple port openings.

FIGS. 4 and 5 illustrate side views of the system 400 according to another exemplary embodiment. The system 400 includes a gasket 468 on the port mounting surface 242 that helps to create a seal between the flange 110 and the port mounting 240. In use, according to the exemplary embodiment, the mounting rail 130 is mounted to the port mounting surface 242 before the flange 110 is attached to the port mounting 240. Once the mounting rail 130 is mounted to the port mounting surface 242, the flange 110 is inserted by positioning the flange at an angle 570 with respect to the port mounting surface 242. The angle 570 may range between about 3-15 degrees. In one embodiment, the angle may be 10 degrees. The tongue 118 of the flange 110 slides through the offset 250 between the edge 246 of the port mounting 240 and the top of the shoulder 138 with minimal force. Once the tongue 118 is set within the shoulder 138, the mounting rail 130 supports the flange 110 as the flange 110 is pivoted toward the port mounting 240 and the flange fasteners 122 are positioned in the port fastener openings 362.

As the flange fasteners 122 extend through the port fastener openings 362 to engagement with the port mounting surface 242, the flange 110 further pivots towards the port mounting 240 until the flange 110 contacts the port mounting surface. Furthermore, as the flange fasteners 122 engage the port mounting surface, a lever arm is created between the flange 110 and the port mounting 240 so that the shoulder 138 applies a leveraged clamping force to the tongue 118 of the flange 110 to force the bottom portion 116 of the flange 110 into contact with the port mounting surface 242. The system 400 thereby seals the flange 110 against port mounting surface of the port mounting 240. In another embodiment, the flange 110 may be brought into contact with the port mounting surface before the flange fasteners 122 engage the port mounting surface to further seal the flange against the mounting surface.

The system 400 allows for the flange 110 to be sealed to the port mounting 240 without using bottom fasteners. This is advantageous in many instances, such as when access to bottom fasteners is limited. Furthermore, the system 400 allows unconstrained thermal expansion of the flange 110 thereby reducing warping and improving the seal between the port mounting 240 and the flange 110. Additionally, the system 400 allows for quick assembly of the flange 110 to the port mounting 240 during manufacture.

What is claimed is:

1. A system for mounting a duct to a port mounting in an engine, the port mounting having an opening and a mounting surface that surrounds the opening, the system comprising:

a flange comprising a flange opening, a first side adjacent the flange opening that accepts fasteners, and a second side opposite the first side with a tongue portion that extends away from the flange opening and mates with the mounting surface of the port mounting; and a mounting rail having a shoulder spaced away from the mounting surface of the port mounting that mates with the tongue portion of the flange, the shoulder not extending over the mounting surface of the port mounting but abutting against the tongue portion.

2. The system of claim 1, wherein the shoulder of the mounting rail is parallel to the mounting surface of the port mounting that mates with the tongue portion of the flange.

3. The system of claim 1, wherein the shoulder is configured and positioned to apply a leveraged clamping force to the tongue portion of the flange.

4. The system of claim 3, wherein the flange is sealed to the port mounting by the shoulder and fasteners applied to the first side of the flange.

5. The system of claim 1, wherein the tongue portion of the flange is initially inserted and positioned between the shoulder and the mounting surface of the port mounting at an angle to the mounting surface of the port mounting.

6. The system of claim 5, wherein the angle is approximately 10 degrees.

7. The system of claim 1, wherein the mounting rail is mounted to an internal combustion engine.

8. The system of claim 7, wherein the mounting rail has a "U" shape formed by first and second arms and a connecting arm that extends between the first and second arms.

9. The system of claim 8, wherein the first and second arms of the "U" shaped mounting rail are mounted to the mounting surface of the port mounting.

10. The system of claim 8, wherein the shoulder is connected to the connecting arm of the "U" shaped mounting rail.

11. The system of claim 1, further comprising a gasket positioned between the flange and the mounting surface of the port mounting.

12. A method of mounting a manifold to a port mounting in an engine, wherein the port mounting has an opening and a mounting surface that surrounds the opening, the method comprising:

positioning a mounting rail adjacent the port mounting, the mounting rail having a shoulder spaced away from the mounting surface of the port mounting, the shoulder not extending over the mounting surface of the port mounting; and inserting a tongue portion of a first side of a flange between the mounting surface of the port mounting and the shoulder of the mounting rail so that the tongue portion abuts both the mounting surface of the port mounting and the shoulder of the mounting rail, wherein the tongue portion of the flange extends away from an opening in the flange and is located opposite a second side of the flange that has fastener openings.

13. The method of claim 12, wherein the flange is at an angle with respect to the mounting surface of the port mounting during the step of inserting the tongue portion.

14. The method of claim 13, further comprising pivoting the flange toward the mounting surface of the port mounting.

15. The method of claim 12, further comprising securing the second side of the flange to the mounting surface of the port mounting using fasteners that extend through the fastener openings.

16. The method of claim 15, wherein the step of securing the second side of the flange to the mounting surface of the port mounting causes the mounting rail to apply a leveraged clamping force to the tongue portion of the flange and seal the flange to the mounting surface of the port mounting.

17. The method of claim 12, further comprising positioning a gasket between the mounting surface of the port mounting and the flange.

18. The method of claim 12, wherein the step of positioning the mounting rail adjacent the port mounting comprises mounting the mounting rail to an internal combustion engine.

19. The method of claim 18, wherein the mounting rail has a "U" shape and the step of mounting the mounting rail to the internal combustion engine comprises mounting first and second arms of the "U" shaped mounting rail to the mounting surface of the port mounting.

20. The method of claim 19, wherein the shoulder of the "U" shaped mounting rail is connected to a connecting arm that extends between the first and second arms.

* * * * *